US005472360A

United States Patent [19]

Prasse et al.

[11] Patent Number: 5,472,360

[45] Date of Patent: Dec. 5, 1995

[54] OIL CONTAINMENT MEANS FOR OUTBOARD MOTOR

[75] Inventors: William Prasse, Oshkosh; Wayne Jaszewski, Jackson; George E. Phillips, Oshkosh; Jeffrey P. Ruhnke, Fond du Lac, all of Wis.

[73] Assignee: Brunswick Corporation, Lake Forest, Ill.

[21] Appl. No.: 367,586

[22] Filed: Jan. 3, 1995

[51] Int. Cl.[6] ..... B63H 21/10

[52] U.S. Cl. ..... 440/88; 440/900

[58] Field of Search ..... 440/88, 89, 900; 123/195 P, 195 R, 195 C, 196 W, 196 S, 196 R; 184/6.18

[56] References Cited

U.S. PATENT DOCUMENTS 4,452,194 6/1984 Watanabe ..... 123/196 W 4,523,556 6/1985 Suzuki ..... 440/88

5,163,394 11/1992 Koishikawa et al. ..... 440/88

*Primary Examiner*—Edwin L. Swinehart

*Attorney, Agent, or Firm*—Wood, Phillips, VanSanten, Clark & Mortimer

[57] ABSTRACT

In an outboard motor having a four cycle power head, a drive shaft housing and an adapter plate therebetween, an oil sump in the drive shaft housing and a lubricating oil system to supply oil to the bearings of the power head, a baffle system including the adapter plate and a second planar baffle between the adapter plate and the drive shaft housing. Oil passages through the adapter plate and the second baffle are positioned on opposite sides of the power head from each other and are longitudinally separated from each other so that the oil will not flow from the oil sump back over the baffles and into the power head when the motor is horizontal.

13 Claims, 5 Drawing Sheets

OIL CONTAINMENT MEANS FOR OUTBOARD MOTOR

FIELD OF THE INVENTION

The invention is in the field of outboard motors and, in particular, pertains to the control and containment of lubricating oil draining from the power head of the motor into an oil sump in the drive shaft housing of the motor.

BACKGROUND OF THE INVENTION

Outboard motors generally comprise a power head consisting of an internal combustion engine of some type standing on end with the crank shaft oriented vertically. The crank shaft is coupled to a drive shaft that extends downwardly supported by a drive shaft housing which also supports a lower unit including a propeller shaft, gears connecting the two shafts and the propeller. The drive shaft housing may also house exhaust ducts which direct exhaust out through the hub of the propeller.

Typically, the power head and drive shaft housing are attached to an adapter plate positioned therebetween. The adapter plate may incorporate means for attaching the motor to a boat and typically has passages therethrough for cooling water and engine exhaust.

Historically, the great majority of outboard motor power heads have been two cycle engines because of their high power to weight ratios. For many years, these two cycle engines were lubricated by mixing oil with the fuel for the engine prior to its induction into the power head. More recently, various other means of lubricating two cycle outboard engines have been introduced which require an oil reservoir separate from the fuel tank. Also, interest in four cycle power heads for outboard motors has greatly increased in recent years.

Lubricating systems for four cycle engine differ from those for two cycle engines due to the fact that the crank case of the four cycle engine is not pressurized during operation of the engine as is the crank case of the two cycle engine. It is therefor possible to utilize a lubricating system wherein the oil is delivered to the bearing surfaces of the engine and allowed to drain by gravity down to the bottom of the engine where it may be collected and pumped to a holding tank as in a dry sump engine; or, directed to a tank in the drive shaft housing.

The invention is directed to the latter arrangement where oil from the power head is permitted to drain by gravity, through passages provided, into an oil tank located in the drive shaft housing.

The use of this arrangement poses a danger of oil flowing in the reverse direction back into the power head when the outboard motor is placed in the horizontal position, as it may be when it is not mounted on a boat. The danger lies in the possibility that oil may find its way into the cylinder head and cause hydraulic lock and possible damage when an attempt is made to start the motor in this condition.

It is the primary purpose of the invention to overcome this problem by preventing the undesirable flow of oil from the oil sump in the drive shaft housing back into the power head.

SUMMARY OF THE INVENTION

The invention comprises a series of baffles positioned between the power head of an outboard motor its drive shaft housing. In one configuration, the adapter plate of the motor comprises a first baffle and a second baffle placed between the adapter plate and the drive shaft housing. An oil flow passage is provided through the first baffle and is located to one side of the power head and either substantially toward the front or toward the back of the power head. An oil flow passage is provided through the second baffle and is located on the other side of the power head from the location of the oil passage through the first baffle, and toward the opposite of the front or back of the power head from the location of the oil passage through the first baffle; whereby oil is generally prohibited from flowing past one of the baffles when the engine is in the horizontal position, provided that the oil sump is not filled above a specified level.

The adapter plate of the invention is comprised of passages therethrough for oil, water and exhaust gas with openings in the top face thereof configured to mate with matching openings for such fluids in the bottom of the power head, openings in the bottom face of the adapter plate for water and exhaust gas configured to mate with matching openings for such fluids in the drive shaft housing; and, a cavity in the bottom face thereof to permit oil to flow to and through the oil passage through the second baffle. The second baffle of the invention may comprise a planar gasket placed between the bottom of the adapter plate and the top of the drive shaft housing having water and exhaust gas passages therethrough configured to sealingly mate with matching passages for such fluids in the bottom of the adapter plate and the top face of the drive shaft housing; and, an oil passage therethrough to allow oil from the cavity in the bottom of the adapter plate to flow through to the oil tank in the drive shaft housing.

DETAILED DESCRIPTION OF THE PREFERRED EMBODIMENT

Figure 1A:
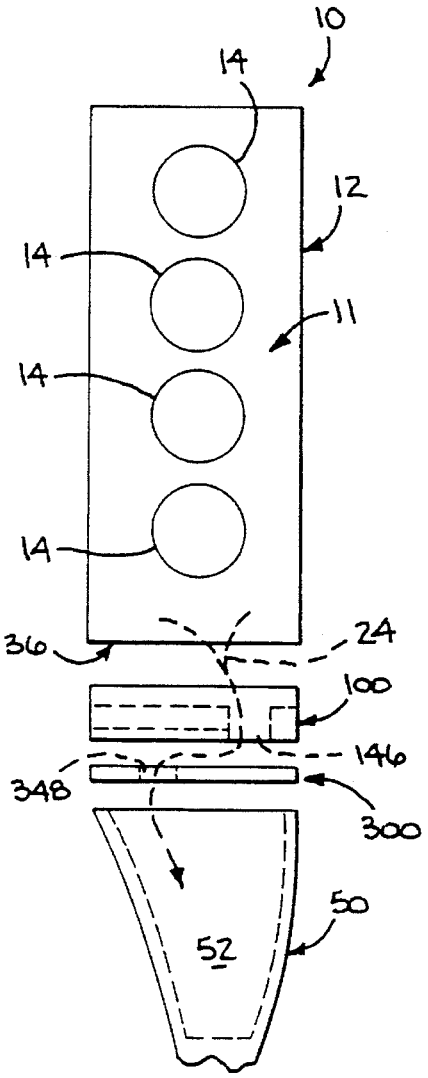
FIG. 1*a* a is a schematic view of an oil containment device of the invention taken from the back of an outboard motor incorporating the invention.
Figure 1B:
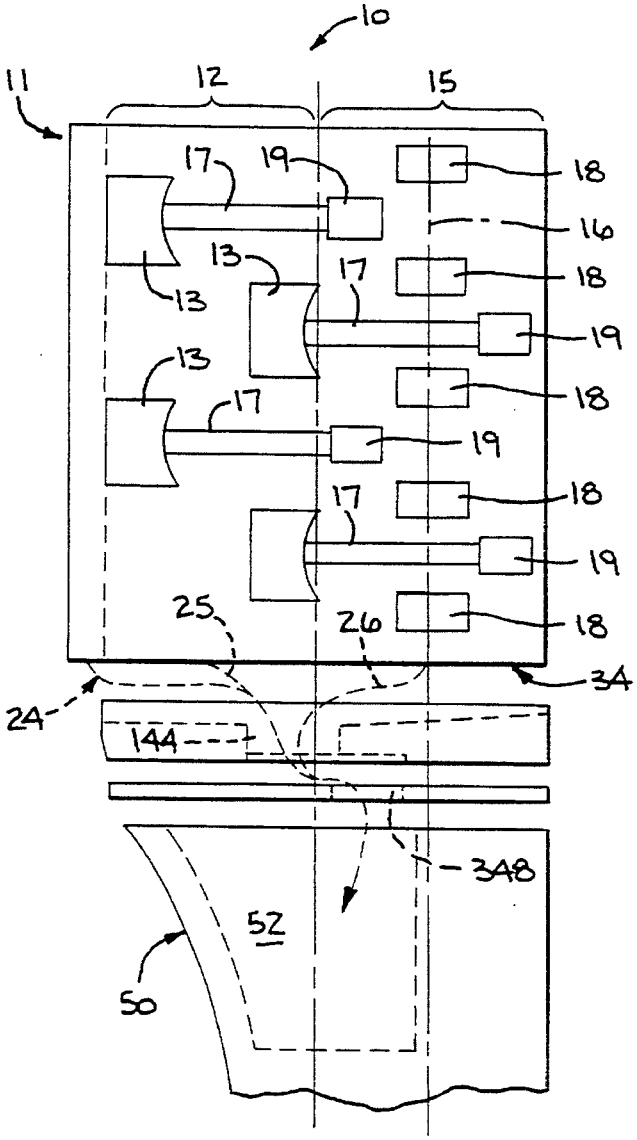
FIG. 1*b* is a schematic view of an oil containment device of the invention taken from the side of an outboard motor incorporating the invention.

The general concept of the invention may be easily understood by reference to FIG. 1. In FIG. 1*a*, oil 24 draining from the bottom of the cylinder head 11 of the power head 10 exits through the passage 36 (see FIG. 3) in the bottom of the power head 10, passes through oil passage 146 in adapter plate 100, flows laterally between the adapter plate 100 and the baffle 300, and through passage 348 in the baffle 300 into the oil tank 52 in the drive shaft housing. Similarly, referring to FIG. 1*b*, oil 26 draining from the crank case section 15 of the power head 10 exist through the passage 34 (see FIG. 3) in the bottom of the power head 10, passes through oil passage 146 in the adapter plate 100, flows longitudinally between the adapter plate 100 and the baffle 300, and through passage 348 in the baffle 300 into the oil tank 52 in the drive shaft housing 50.

It will be evident from inspection of FIGS. 1*a* and 1*b* that oil flow from the tank 52 back into the power head 10 will be restricted by the placement of the passages 146 and 348 in the baffles 100 and 300, respectively; provided that the oil tank 52 is not overfilled. Overfilling may cause oil to overflow the baffles when the motor is placed on its side, front or back.

Figure 2:
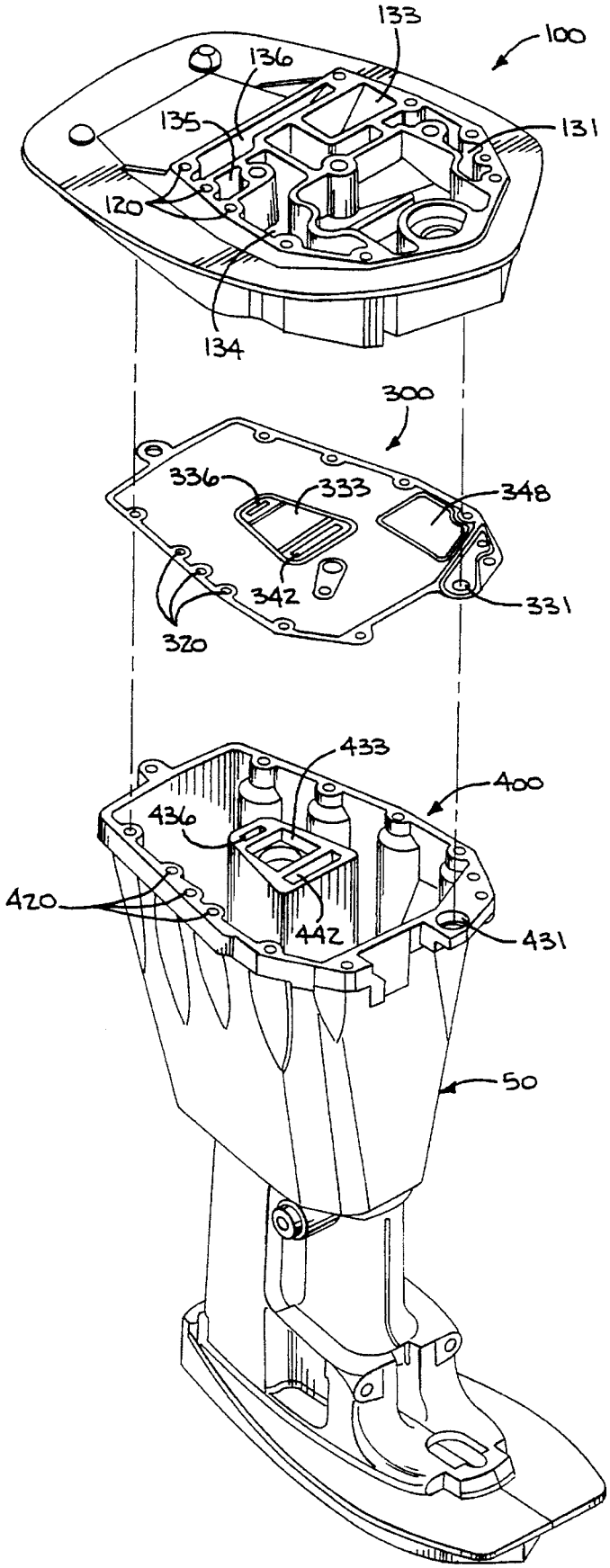
FIG. 2 is an exploded view of a lower portion of an outboard motor incorporating the invention showing an adapter plate, gasket/baffle and drive shaft housing of the motor.

FIG. 2 is an exploded view, in perspective of the primary elements of one embodiment of the invention, including an adapter plate 100 and a baffle plate 300, described below in detail, positioned for assembly atop a drive shaft housing 50.

In viewing the drawings, note that the last two digits of the numbers identifying matching cavities and passages in the power head 10, the adapter plate top 100 and bottom 200, the baffle 300 and the top 400 of the drive shaft housing 50 are identical.

Figure 3:
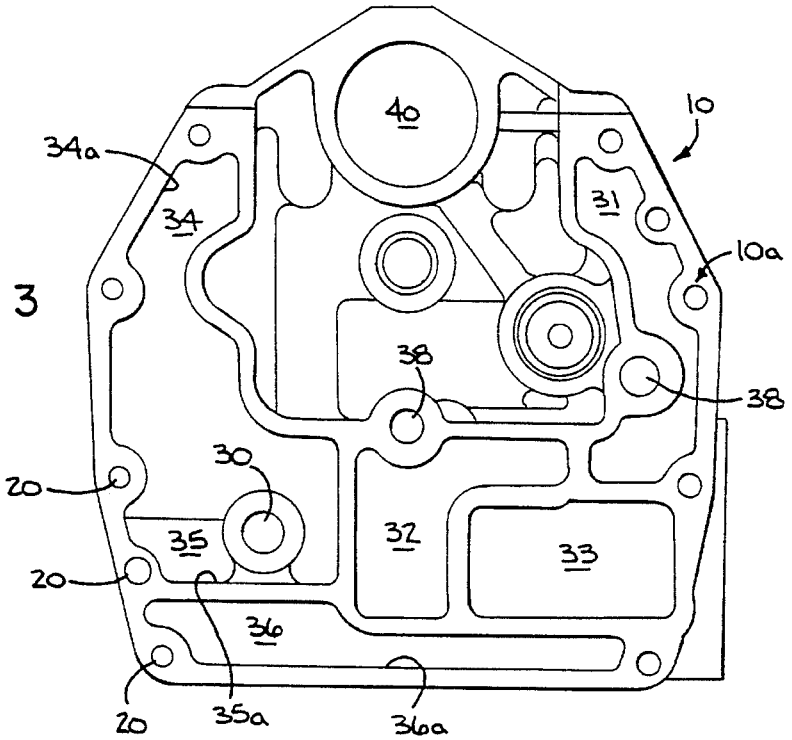
FIG. 3 is a plan view of the bottom face of a four cycle engine power head for an outboard motor showing the oil, water and exhaust gas passages therethrough.
Figure 4:
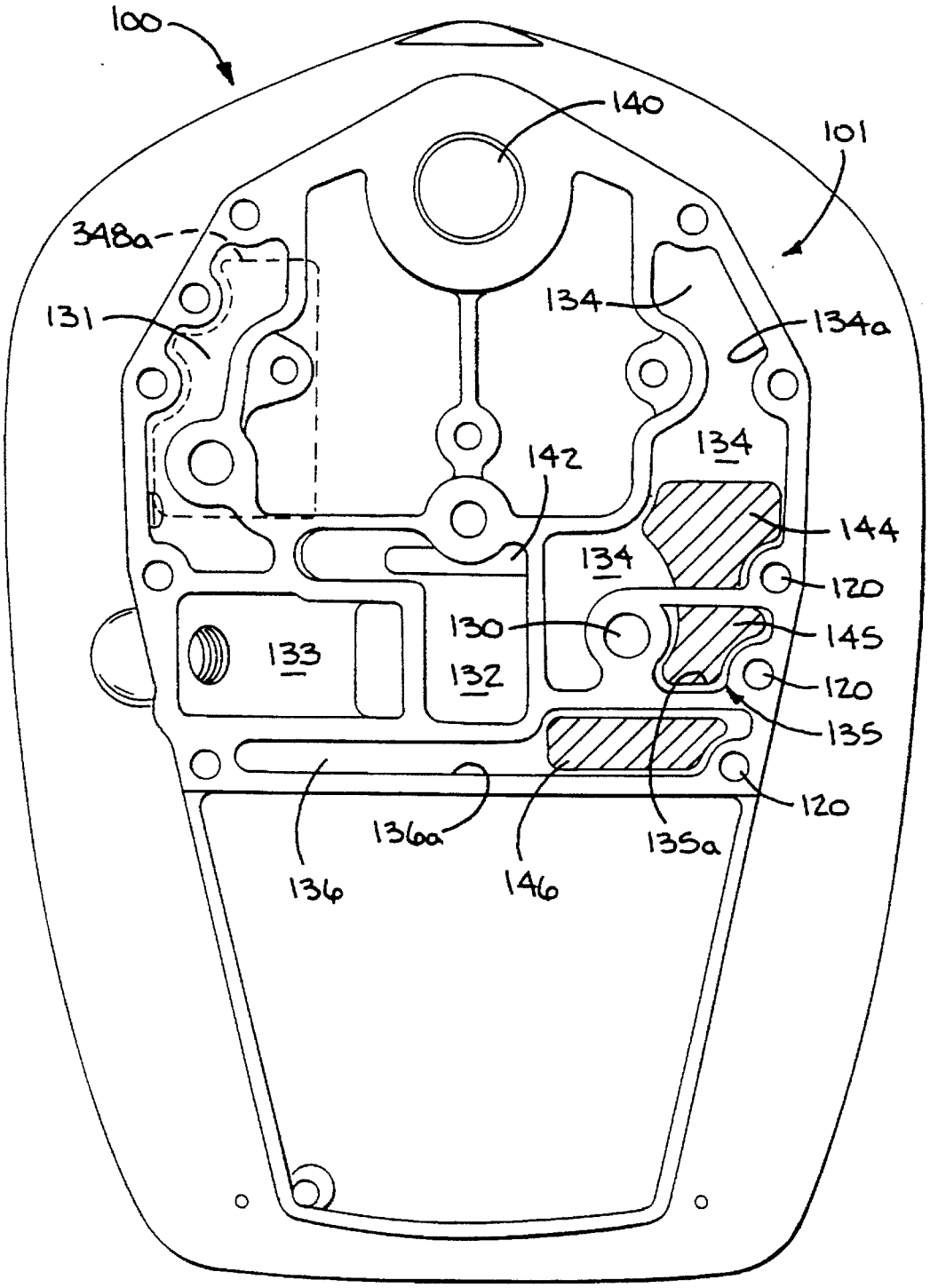
FIG. 4 is a plan view of the top of an adapter plate of the invention showing the oil, water and exhaust gas passages therein.

Referring to FIG. 3, the bottom face of the power head 10, oil draining from the cylinder head section 11 of the engine flows into cavity 36 in the bottom face 10*a* of the power head 10. Oil draining from the crank case 15 flows into cavities 34 and 35. Referring to FIGS. 3 and 4, the peripheral walls 34*a*, 35*a* and 36*a* of the cavities 34, 35 and 36 (FIG. 3) match the peripheral walls 134*a*, 135*a* and 136*a* of cavities 134, 135 and 136 in the top 101 of the adapter plate 100 (FIG. 4), so that the mating cavities form flow passages for the oil when the power head 10 and adapter plate 100 are assembled together. Oil entering the cavities 134, 135 and 136 in the top 101 of the adapter plate 100, is free to continue its downward path through the passages 144, 145 and 146, indicated by the hatched areas in FIG. 4. These passages extend entirely through the adapter plate 100 and open into a cavity 250 between the bottom face 201 of the adapter plate 100 and the lower baffle 300, created by the height of the peripheral wall 203 above the bottom 251 of the adapter plate 100. The cavity 250 may be cast into the bottom face 201 of the adapter plate 100.

Figure 6:
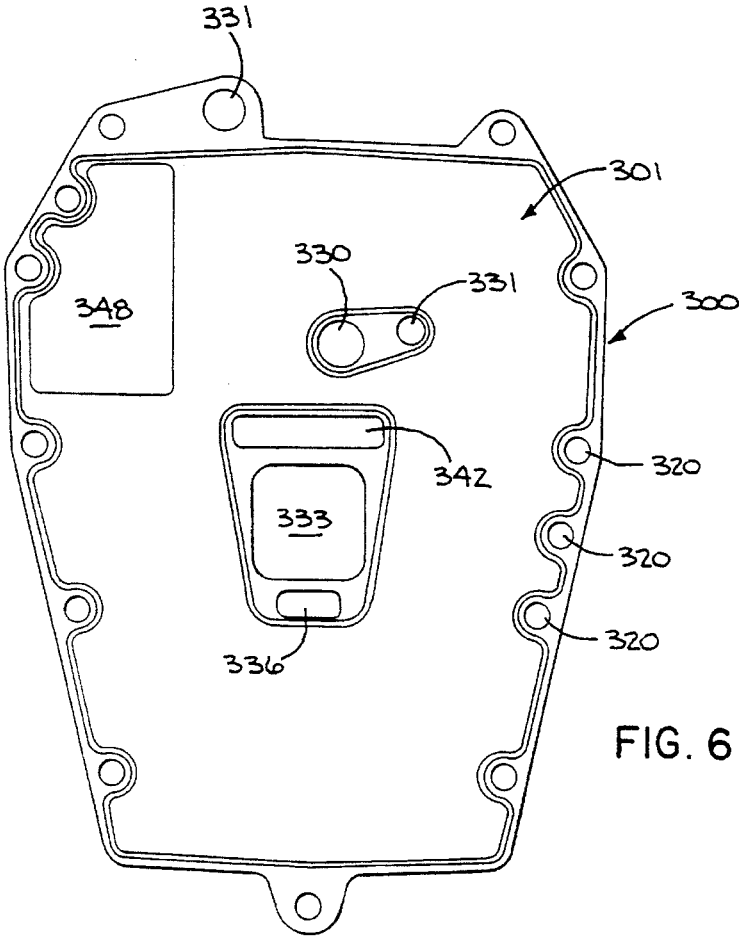
FIG. 6 is a plan view of a gasket/baffle of the invention showing the oil, water and exhaust gas passages therethrough.

Once in the cavity 250 (FIG. 5), the oil is free to flow to and down through an opening 348 through the baffle 300 (FIG. 6) and fall into the oil tank 52.

The tortuous path for the draining oil described above is evident from an inspection of FIG. 4 wherein the position of opening 348 through the baffle plate 300 is shown by a dotted line 348a superimposed upon the top face 101 of the adapter plate 100. In order for oil to flow back into the power head 10 from the oil tank 52 when the outboard motor is laid on its side, front or back, oil must travel the reverse of this tortuous path.

Figure 5:
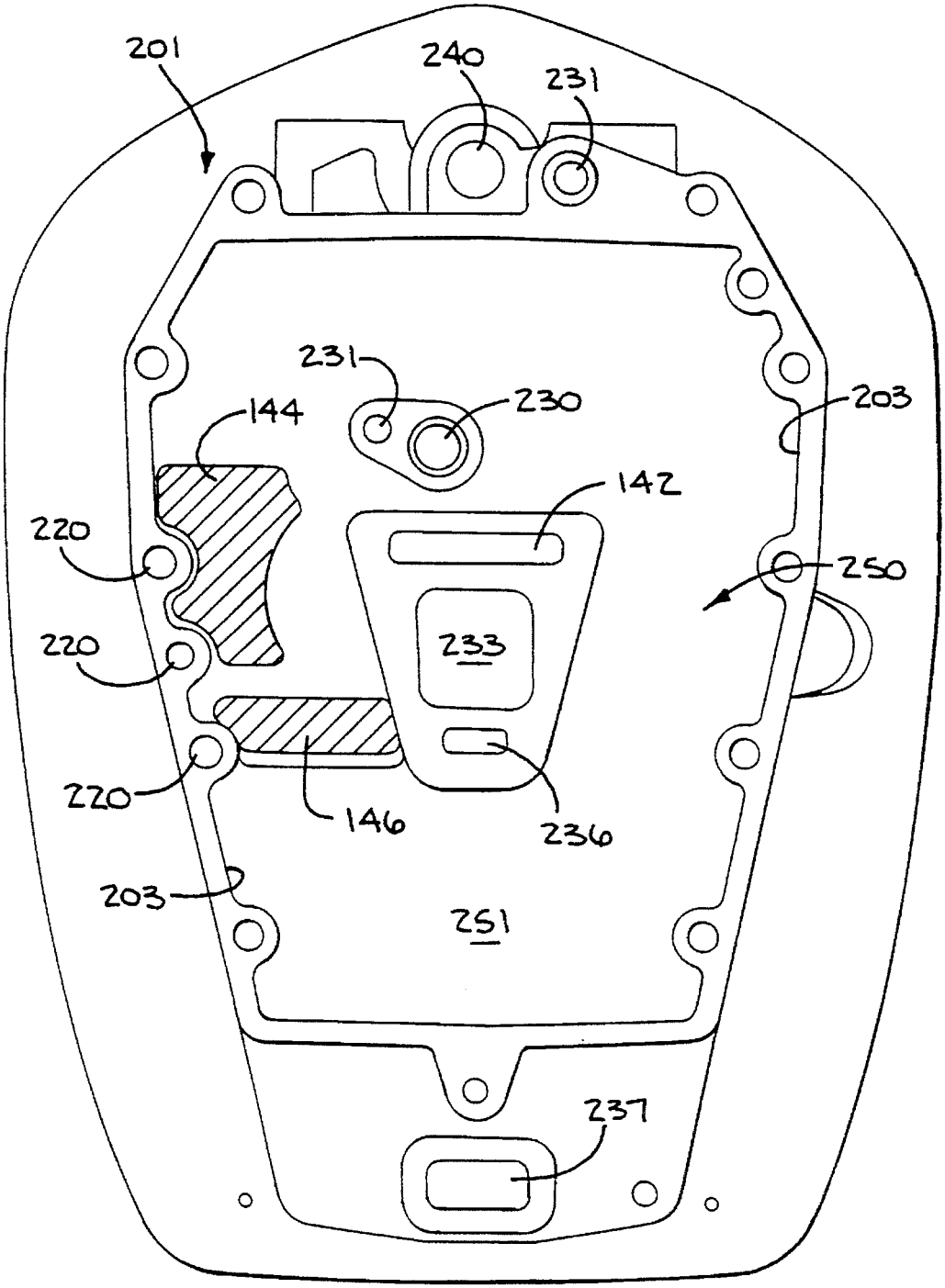
FIG. 5 is a plan view of the bottom of an adapter plate of the invention showing the oil, water and exhaust gas passages therein.

While the embodiment of the invention described is primarily directed to the control of oil flow, provisions for the flow of water and exhaust gas through the adapter plate 100 and the baffle 300 may also be incorporated. Referring to FIGS. 4 and 5, a water inlet passage 231 in the bottom face 201 of the adapter plate 100 leads through an internal passage (not shown) to a water inlet cavity 131 in the top 101 of the adapter plate 100. When the power head 10 is assembled to the adapter plate 100, cavity 131 is sealingly mated with its matching companion cavity 31 in the power head 10 providing an inlet for cooling water to the power head 10.

Similarly, matching companion cavities 32 and 132 in the bottom of the power head 10 and the top face 101 of the adapter plate 100, respectively, provide an exit for cooling water leading to a passage 142 through the adapter plate 100. The shape of passage 142 in the bottom face 201 of the adapter plate 1 00 matches and is sealingly engaged with the passage 442 in the drive shaft housing 50 when the power head 10 and the adapter plate 1 00 are assembled to the drive shaft housing 50.

Matching companion cavities 33 and 133 in the power head 10 and the adapter plate 100, respectively, provide an exit passage for exhaust gases from the power head 10 which leads downwardly to exhaust passage 233 through the bottom face 201 of the adapter plate 100.

The lower baffle 300 functions generally as a gasket to seal the top face 400 of the drive shaft housing 50 to the bottom face 201 of the adapter plate 100; and in particular the matching passages 142, 233 and 236 in the bottom face 201 with passages 442, 433 and 436 in the face 400 of the drive shaft housing 50.

The shape of passage 142 at the bottom face 201 of the adapter plate 100 matches the shape of exhaust passage 433 (FIG. 2) at the top 400 of the drive shaft housing 50. The various matching passages are sealed as the power head 10, adapter plate 100, gasket baffle 300 and drive shaft housing are fastened together by bolts which pass through the bolt holes 20, 120, 320 and 420 in the aforementioned components of the outboard motor. An additional passage is provided for exhaust gas when the engine is idling, comprising passage 436 through a center post 450 in the drive shaft housing 50 which matches passages 336 and 236 through the baffle 300 and the bottom face 201 of the adapter plate 100. The idle relief passage continues internally of adapter plate 100 (not shown) to exhaust port 237 in the underside 201 of the adapter plate 100.

An oil supply tube (not shown) extends down into the oil tank 52 to draw oil from the tank. The oil supply tube is attached to the bottom face 201 of the adapter plate 100 in alignment with the oil inlet passage 230 therein. The gasket baffle 300 functions to seal the supply tube to the inlet passage 230 and has an appropriately aligned oil passage 330 therethrough. The oil tube is secured to the bottom face 201 of the adapter plate 100 by a suitable bolt which passes through a hole 331 in the baffle 300 and into a receiving threaded bore 231 in the bottom face 201 of the adapter plate 100.

The drive shaft 16 of the power head 10 passes downwardly through bores 140 and 240 in the top and bottom faces 101 and 201, respectively, of the adapter plate 100.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an outboard motor having a power head, a drive shaft housing supporting a drive shaft, propeller shaft and propeller, an oil tank in the drive shaft housing and a pressurized oil system for the power head, means for substantially preventing oil in the tank from flowing into the power head when the outboard motor is placed in a horizontal position comprising, a first oil baffle positioned adjacent to the bottom of the power head, an oil passage through the first baffle located on one side and generally to one of the front and back of the motor defined by a lateral vertical plane bisecting the power head, and a second oil baffle positioned between the first oil baffle and the drive shaft housing, an oil passage through the second oil baffle located on the other side and generally to the other of the front and back of the motor defined by the lateral vertical plane bisecting the power head.

2. The motor of claim 1 wherein the oil passages through the first and second baffles are positioned in opposite quadrants of the power head.

3. The motor of claim 1 wherein the first oil baffle comprises an adapter plate means for attaching the drive shaft housing to the power head.

4. The motor of claim 1 wherein the first oil baffle comprises top and bottom surfaces, the top surface having a plurality of depressions therein for collecting lubricating oil draining from the power head, said depressions opening to an oil passage through the adapter plate.

5. The motor of claim 4 wherein the oil passage through the first oil baffle comprises a plurality of oil passages, each communicating with one of the oil collecting depressions.

6. The motor of claim 1 wherein a portion of the bottom surface of the first oil baffle communicating with an oil passage is spaced apart from the second oil baffle so that oil may flow therebetween to the oil passage through the second baffle.

7. The motor of claim 6 wherein the second oil baffle is planar and comprises a gasket between the adapter plate and the drive shaft housing.

8. In an outboard motor comprised of a four cycle piston driven internal combustion engine power head, a drive shaft housing and adapter means for joining the power head and the drive shaft housing, an oil tank located below the adapter means, and a lubricating oil system for the engine wherein oil supplied to the moving parts of the engine drains by gravity from the engine through the adapter means to the oil tank, an improved means for preventing oil in the oil tank from flowing from the oil tank back into the engine when the outboard motor is placed in a horizontal position comprising:

a first oil passage through the adapter means;

an oil baffle positioned between the adapter means and the drive shaft housing;

a second oil passage through the oil baffle, said first and second oil passages being positioned on opposite sides of the motor relative to one another, and one of the first and second oil passages being positioned substantially forward of the other relative to a fore and aft axis of the adapter means.

9. The motor of claim 8 wherein the adapter means comprises a three dimensional adapter plate and a baffle adjacent thereto, the entry to the oil passage is in the adapter plate and the exist of the oil passage is through the baffle.

10. The motor of claim 9 where the adapter plate has a cavity therein which together with the baffle forms a portion of the tortuous oil passage through the adapter means.

11. The motor of claim 9 wherein the adapter plate comprises a first cavity for receiving oil draining from the crank case of the power head and a second cavity for receiving oil from the cylinder head of the power head.

12. The motor of claim 11 wherein the adapter plate has at least one oil passage therethrough connecting with an oil receiving cavity of the adapter plate.

13. The motor of claim 11 wherein the cross sectional area of a passage through the adapter plate connecting with an oil receiving cavity in the adapter plate is smaller than the cross sectional area of the oil receiving cavity.

* * * * *